US007481311B1

(12) United States Patent
Old

(10) Patent No.: US 7,481,311 B1
(45) Date of Patent: Jan. 27, 2009

(54) GOLD CLUB BAG FOR USE WITH GOLF CART

(76) Inventor: James A. Old, 2555 W. Bluff Ave. #172, Fresno, CA (US) 93711

( * ) Notice: Subject to any disclaimer, the term of this patent is extended or adjusted under 35 U.S.C. 154(b) by 0 days.

(21) Appl. No.: 11/716,180

(22) Filed: Mar. 9, 2007

Related U.S. Application Data

(60) Provisional application No. 60/780,205, filed on Mar. 9, 2006.

(51) Int. Cl.
*A63B 55/00* (2006.01)

(52) U.S. Cl. ..... 206/315.6; 206/315.3; 206/315.5

(58) Field of Classification Search ..... 206/315.3, 206/315.5, 315.6; 280/DIG. 6
See application file for complete search history.

(56) References Cited

U.S. PATENT DOCUMENTS

| | | | | | |
|---|---|---|---|---|---|
| D57,526 | S | | 4/1921 | Hunt | |
| 1,956,008 | A | * | 4/1934 | Diebel | 206/315.6 |
| 1,960,862 | A | | 5/1934 | Baldwin | 280/58 |
| 2,070,254 | A | * | 2/1937 | Burgner | 211/70.2 |
| 2,422,315 | A | * | 6/1947 | Robinson | 206/315.7 |
| 2,471,169 | A | * | 5/1949 | Salzberg et al. | 206/315.4 |
| 2,722,258 | A | * | 11/1955 | Smidt et al. | 206/315.6 |
| 2,962,294 | A | | 11/1960 | Elias | 280/38 |
| 3,779,297 | A | * | 12/1973 | Stammer | 206/315.6 |
| 3,967,667 | A | * | 7/1976 | Robinson | 206/315.6 |
| D248,337 | S | | 6/1978 | Marx | D87/1 R |
| 4,319,616 | A | * | 3/1982 | Light | 206/315.2 |
| 4,340,236 | A | | 7/1982 | Seibold et al. | 280/38 |
| 4,383,563 | A | * | 5/1983 | Kirchhoff, Jr. | 206/315.2 |
| 4,655,346 | A | * | 4/1987 | Reinholz | 206/315.6 |
| 4,858,761 | A | * | 8/1989 | Fumia | 206/315.3 |
| 5,358,109 | A | * | 10/1994 | Nichols | 206/315.3 |
| 5,472,084 | A | * | 12/1995 | Aliano, Jr. | 206/315.3 |
| 5,480,178 | A | | 1/1996 | Suk | 280/646 |
| 5,573,112 | A | | 11/1996 | Kim | 206/315.6 |
| 5,785,173 | A | | 7/1998 | Kim | 206/315.6 |
| 5,816,398 | A | | 10/1998 | Wang | 206/315.6 |
| D411,665 | S | | 6/1999 | Wang | D3/320 |
| D413,018 | S | | 8/1999 | Boldig et al. | D3/255 |
| 5,970,561 | A | * | 10/1999 | Archibeque | 15/161 |
| 5,984,395 | A | * | 11/1999 | Halpen | 294/143 |
| 5,988,379 | A | * | 11/1999 | Yearous | 206/315.3 |
| D419,294 | S | | 1/2000 | Wang | D3/255 |
| D427,431 | S | | 7/2000 | Jensen | D3/255 |
| 6,126,050 | A | * | 10/2000 | Aliano, Jr. | 224/274 |
| 6,149,041 | A | * | 11/2000 | Perino et al. | 224/645 |
| D436,440 | S | | 1/2001 | Stokes | D3/255 |
| D439,403 | S | | 3/2001 | Cetin | D3/255 |
| D453,323 | S | | 2/2002 | Conrad | D13/154 |
| 6,352,187 | B2 | | 3/2002 | Strode | 224/664 |

(Continued)

OTHER PUBLICATIONS

All-Leather Caddy Bags. Downloaded May 18, 2007 at www.golftodaymagazine.com/0506Jun/great.htm.

*Primary Examiner*—Sue A Weaver
(74) *Attorney, Agent, or Firm*—Haverstock & Owens LLP

(57) ABSTRACT

A golf bag for use with a golf cart including a center section and side sections. Golf clubs are held in the side sections, which are able to rotate, detach or both. The golf bag is easily strapped in a standard golf cart. Pockets and other accessory holders located on the center section are easily accessible when strapped to a cart.

18 Claims, 6 Drawing Sheets

U.S. PATENT DOCUMENTS

| | | | | |
|---|---|---|---|---|
| D472,375 | S | 4/2003 | Stokes | D3/255 |
| D501,602 | S | 2/2005 | Karlsson et al. | D3/287 |
| D510,805 | S | 10/2005 | Wang | D3/320 |
| 6,988,738 | B2 | 1/2006 | Lu | 280/47.26 |
| 2002/0066763 | A1* | 6/2002 | Hsueh | 224/901.2 |
| 2002/0195359 | A1* | 12/2002 | Uner et al. | 206/315.3 |
| 2007/0039794 | A1 | 2/2007 | Hwang | 190/18 A |

* cited by examiner

GOLD CLUB BAG FOR USE WITH GOLF CART

RELATED APPLICATIONS

The present application was first described in Disclosure Document No. 575,969. The present application claims priority to U.S. Provisional Patent Application 60/780,205, filed on Mar. 9, 2006, and entitled "Golf Club Bag For Use With Golf Cart" to the same inventor under U.S.C. section 119(e). This application incorporates U.S. Provisional Patent Application 60/780,205, filed on Mar. 9, 2006, and entitled "Golf Club Bag For Use With Golf Cart" to the same inventor by reference in its entirety.

FIELD OF THE INVENTION

The present invention relates to golf bags, and more particularly to golf bags which allow easy access to clubs and which are designed for use with a golf cart.

BACKGROUND

Golf is a popular leisure time outdoor activity for men and women of all ages. While playing golf, one not only enjoys the benefits of fresh air and social interaction, they also gain the benefit of exercise in swinging the clubs and some walking. The game of golf requires using a number of various clubs. Some clubs are used hit the golf ball especially far, some clubs are designed to pitch the ball high in the air, some clubs are especially suited for playing obstacles such as sand traps and finally, a putter is needed to putt the ball into the hole. Besides clubs, golfers may need various other tools and effects on the golf course during their round of golf such as extra balls, tees, gloves, umbrellas, golf shoes, wallet, car keys, and the like.

Golf bags are almost universally used to carry clubs and other ancillary items. Traditional golf bags use slots in the top of the bag to accept the golf clubs and use pockets, zippers, snaps and clips to hold items in the bag and to the bag. Typically pockets are placed around the entire circumference of the bag. Golf bags designed this way have two major downfalls.

First, these bags can become very heavy when all the desired gear is put inside. The golf bag becomes more burdensome and heavy as the user loads the bag with gear. Furthermore, golf courses are very long, sometimes as long as 8,000 yards. Thus, many golfers do not possess the physical stamina to carry their golf bag on the entire course. Golf carts are often used to alleviate this problem; however, golf carts do not help a golfer who needs to carry multiple clubs to a tee box or to another shot in which the cart is not allowed.

Second, traditional golf bags are not designed to allow easy access when used with a golf cart. Typical golf carts are small vehicles, built for two occupants, with a section on the back of the cart to hold two golf bags. Bags are strapped onto the cart and held rigidly in place. Such a placement, however, limits the functionality of the golf bag. When a golf bag is tethered to a cart, half of the pockets are effectively rendered useless since they are strapped to the cart in an inaccessible fashion. Golfers who organize their bags by placing items all the pockets must either reach around the bag and feel blindly for items or unstrap the bag, turn it, retrieve what they need, turn the bag back around and finally, strap the bag back into place. This process takes time, agility and strength. Furthermore, for some golfers, it can be difficult to see some of the clubs when in a cart because they can be higher than eye level.

Further, there are courses or times on most courses when the cart is not allowed off the cart path. At such times, especially when the ball is lying far from the cart, it is not often possible to select the desired club until standing at the ball and closely examining the position of the ball relative to the terrain, plants and adjacent topography. In such circumstances, the golfer must either bring their entire bag, pull a number of clubs from their bag or make at least two trips between the cart and their ball. Pulling and carrying multiple loose clubs provides an unnecessary opportunity for damage to the pulled clubs.

The present invention solves some of these problems associated with golf bag organization and using golf bags with carts.

SUMMARY OF THE DISCLOSURE

A golf club bag includes enhanced features to increase its versatility, especially when used with a golf cart. The golf bag comprises a center section and two side sections for holding clubs. In some embodiments, the side sections attach and detach. In some embodiments, the side sections rotate about a pivot point. In other embodiments, the side sections attach, detach and rotate. In some embodiments, the center section has drawers, pouches, pockets, openings, shelves, surfaces, slots or the like to organize and store golf accessories. In some embodiments, the side sections detach and can be carried independently from the rest of the bag. In some embodiments, the side sections have insert packs which hold the clubs, the inserts which are independently detached from the side sections. Such insert packs can contain a certain group of clubs. In some embodiments of the present invention, the bag is strapped to a golf cart for easy access to clubs and accessories.

BRIEF DESCRIPTION OF THE DRAWINGS

The novel features of the invention are set forth in the appended claims. However, for the purpose of explanation, several embodiments of the invention are set forth in the following figures.

DETAILED DESCRIPTION

Figure 1:
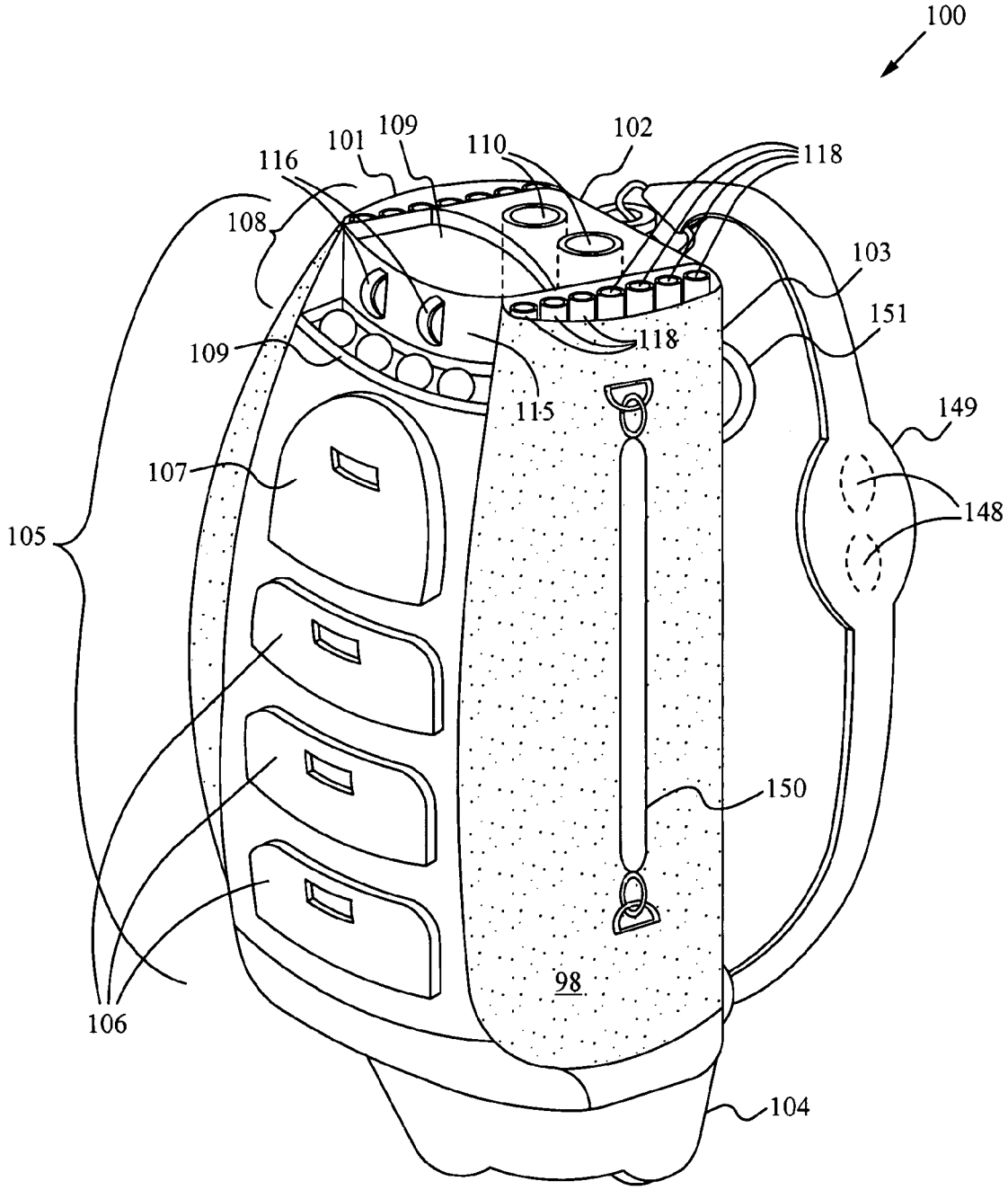
FIG. 1 is an isometric view of some embodiments of the present invention with side sections covered in material.

FIG. 1 is an isometric view of the golf bag 100 of the present invention with a center section 102 and detachable side sections 101 and 103.

The center section 102 provides the overall structural support and gives the bag 100 its overall shape. The center section 102 includes a base 104, a vertical, rigid body 105, accessory drawers 106, accessory pocket 107 and a top section 108. The top section 108 provides storage surfaces 109 for storing small objects such as golf balls, score cards and golf tees. Also on the top section 108 is a strap area 115 for accommodating a golf cart strap (not shown). The strap area 115 is a flat area with a series of loops 116 to hold the golf cart strap (not shown). Finally, two accessory channels 110 for storing long narrow accessories such as umbrellas or golf ball retrievers are located in the rear of the top section 108 and entered downward through the golf bag 100. The center section also has a carrying strap 149 which is used to carry the golf bag 100 on a golfer's shoulder or across their back. The carrying strap 149 preferably has a number of pads 148 formed inside for more comfortable use.

The side sections 101 and 103 are coupled to the center section 102 by a coupling mechanism (shown below). As shown, the exterior of the side sections 101 and 103 are covered with a sheeting material (indicated by a dotted pattern). The side sections 101 and 103 house a number of golf club holders 118. Preferably, each side section houses seven golf club holders 118. This allows only a total of fourteen total clubs to be carried. Fourteen is the maximum number of clubs allowed to be carried according to the rules of the United States Golf Association. The side sections 101 and 103 also have a removable strap 150 and a handle 151.

Figure 2:
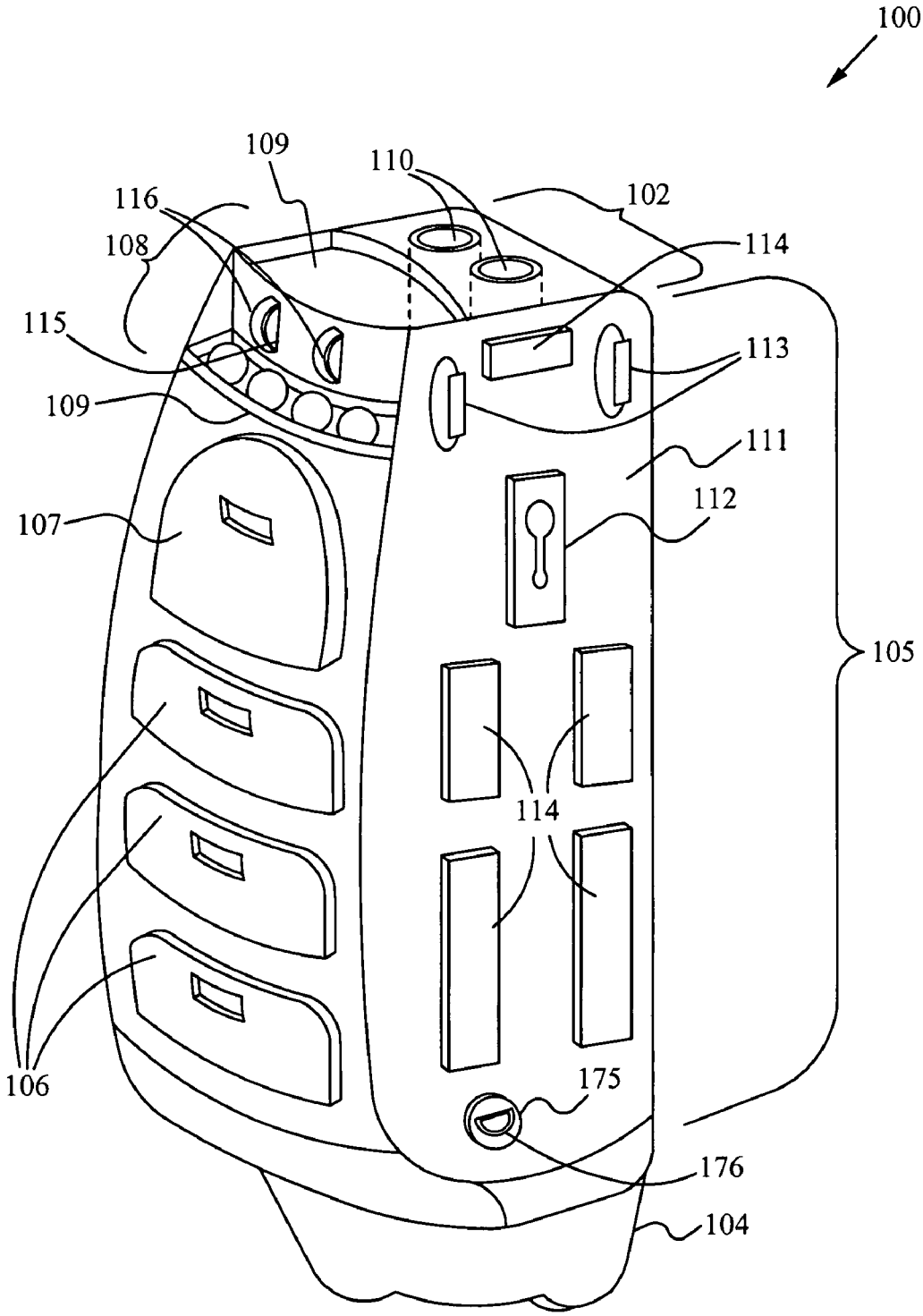
FIG. 2 is an isometric view of some embodiments of the present invention without the side sections.

FIG. 2 is an isometric view of the center section 102 of the golf bag of the present invention shown without the detachable sides 101 and 103. The vertical body 105 of the center section 102 has two substantially flat sides 111 in which the side sections 101 and 103 (not shown here) attach to and detach from. The vertical body 105 is preferably sufficiently rigid to provide structure and shape to the golf bag 100. The two sides 111 preferably each have a lockable pivot mechanism 112 on its face which couples with the detachable side sections (not shown). The sides 111 also have rings 113 for a golf cart strap (not shown) to be threaded through. Furthermore, the sides 111 have bumpers 114 to help support the sides upright and reduce rattling of the clubs. A stopping mechanism 175 with a pull ring 176 is located near the bottom of the center section 102. The pull ring 176 pulls out a bar (not shown) which acts to stop the rotation of the side sections 101 or 103.

Figure 3:
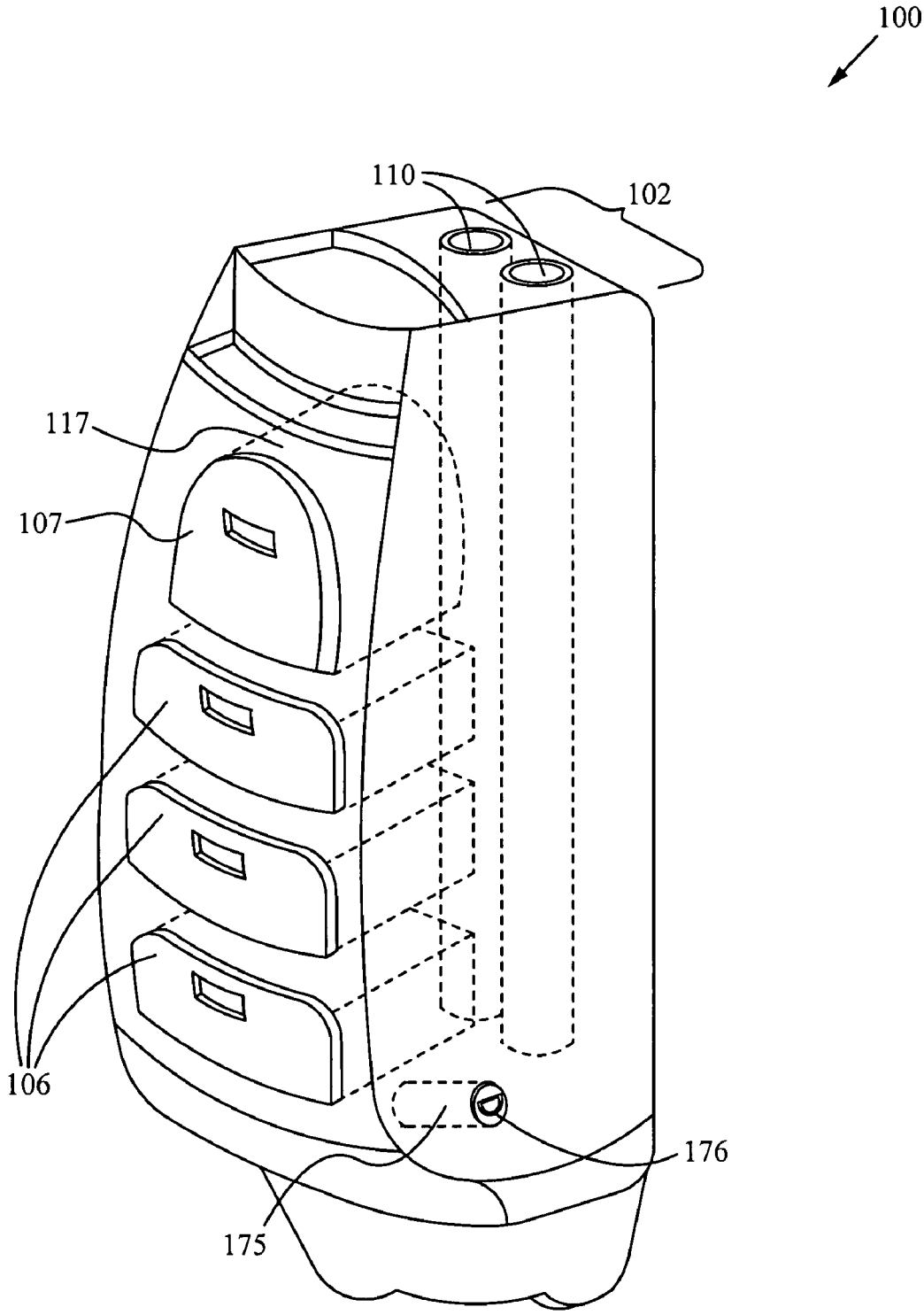
FIG. 3 is an isometric view of some embodiments of the present invention showing the inside of the center section.

FIG. 3 is an isometric view of the center section 102 of the golf bag of the present invention showing external features as well as certain inside features (shown with broken lines) of the center section 102. The accessory drawers 106 extend into the center portion 102 and can be used to store equipment. This feature is an advantage over existing bags since almost the entire depth of the bag can be conveniently accessed from the front of the bag, eliminating the need to turn the bag around to access accessories or to dig through deep pockets as required in a conventional golf bag. The accessory pocket 107 opens with a zipper or other suitable opening means and allows access to a bulk pocket 117. The bulk pocket 117 is capable of holding bulky equipment such as a rain jacket or shoes. The accessory channels 110 extend down the back of the center section 102 to provide room to store long narrow items such as umbrellas or golf ball retrievers. The stopping means 175 is a bar, which is accessible from the center section 102, is stored in the center section and pulled out via the pull ring 176.

Figure 4:
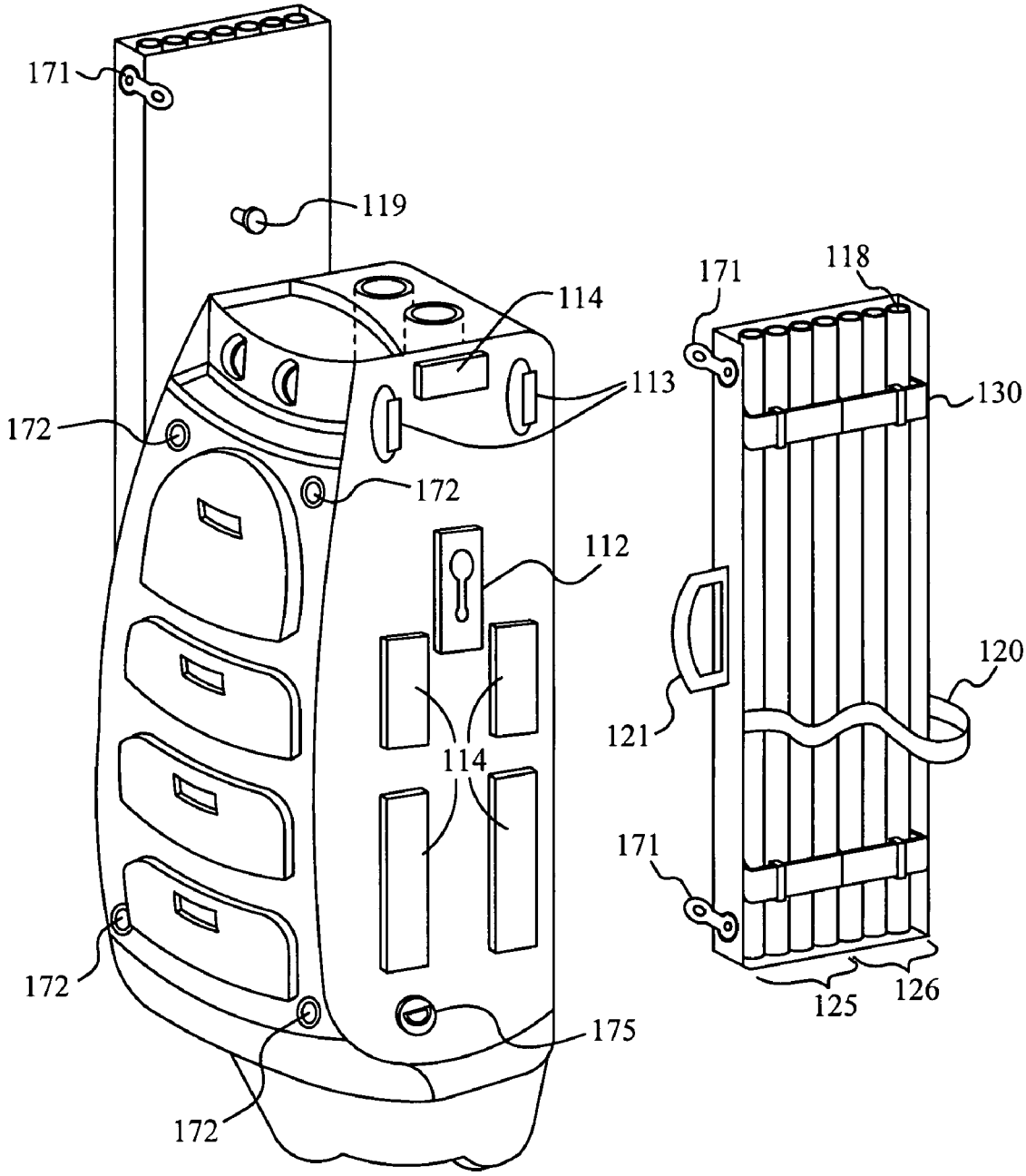
FIG. 4 is an isometric view of some embodiments of the present invention with the side sections positioned to be attached.

FIG. 4 is an isometric view of the golf club bag according to some embodiments of the present invention shown with the detachable side sections 101 and 103 ready to be attached and with the material 98 (shown in FIG. 1) absent. The detachable side sections 101 and 103 house the club holders 118. As shown, the club holders 118 can optionally be are grouped into two or more groups 125 and 126. These groups contain three or four club holders 118 held together. The club holders 118 in the groups 125 and 126 can be held together with a strap 130 or can be integrally wrapped in some material. Unlike in FIG. 1, in which the entirety of the side sections 101 and 103 are covered by material 98, the optional groups of club holders 125 and 126 depicted in FIG. 4 are independently accessible.

The detachable side sections 101 and 103 each have a pivot 119 attached to the back side to correspond to the lockable pivot mechanism 112. Detaching the side sections 101 and 103 is accomplished by simply lifting up on the side section to disengage the pivot from the lockable pivot mechanism 112. Attaching a side section is accomplished by simply lining up the pivot 119 with the lockable pivot mechanism 112 and allowing the pivot to engage through a relatively large upper opening and slide to click into place. When attached, the body of the detachable sides rests against the bumpers 114.

When attached, the side sections 101 and 103 can rest in a vertical position or can rotate. With the appropriate force, a user can rotate the side section 103 by pivoting the side section 103 about the pivot 119 in the lockable pivot mechanism 112. The rotating feature provides the present invention with an advantage over traditional golf bags. A shorter golfer may not be able to see the clubs in a bag, especially if the bag is elevated in a golf cart. The present invention allows the clubs to be rotated toward the user, allowing the user to see the clubs more clearly for selection.

In some embodiments of the present invention, a securing means is provided to keep the side sections 101 and 103 from rotating. As shown in FIG. 4, the securing means are snap buttons 171 and 172. The female end of the snap button 171 is coupled to the side sections 101 and 103 and the male end of the snap button is coupled to the center section 102. When the side sections 101 or 103 are in an upright position, the female ends 171 snap onto the male ends 172, thus preventing the side sections 101 or 103 from rotating.

As shown, the detachable side 103 can accommodate seven clubs in the club holders 118. When detachable side 103 is detached from the center section 102, the user can independently carry detachable side 103 via strap 120 or via the handle 121.

Figure 5:
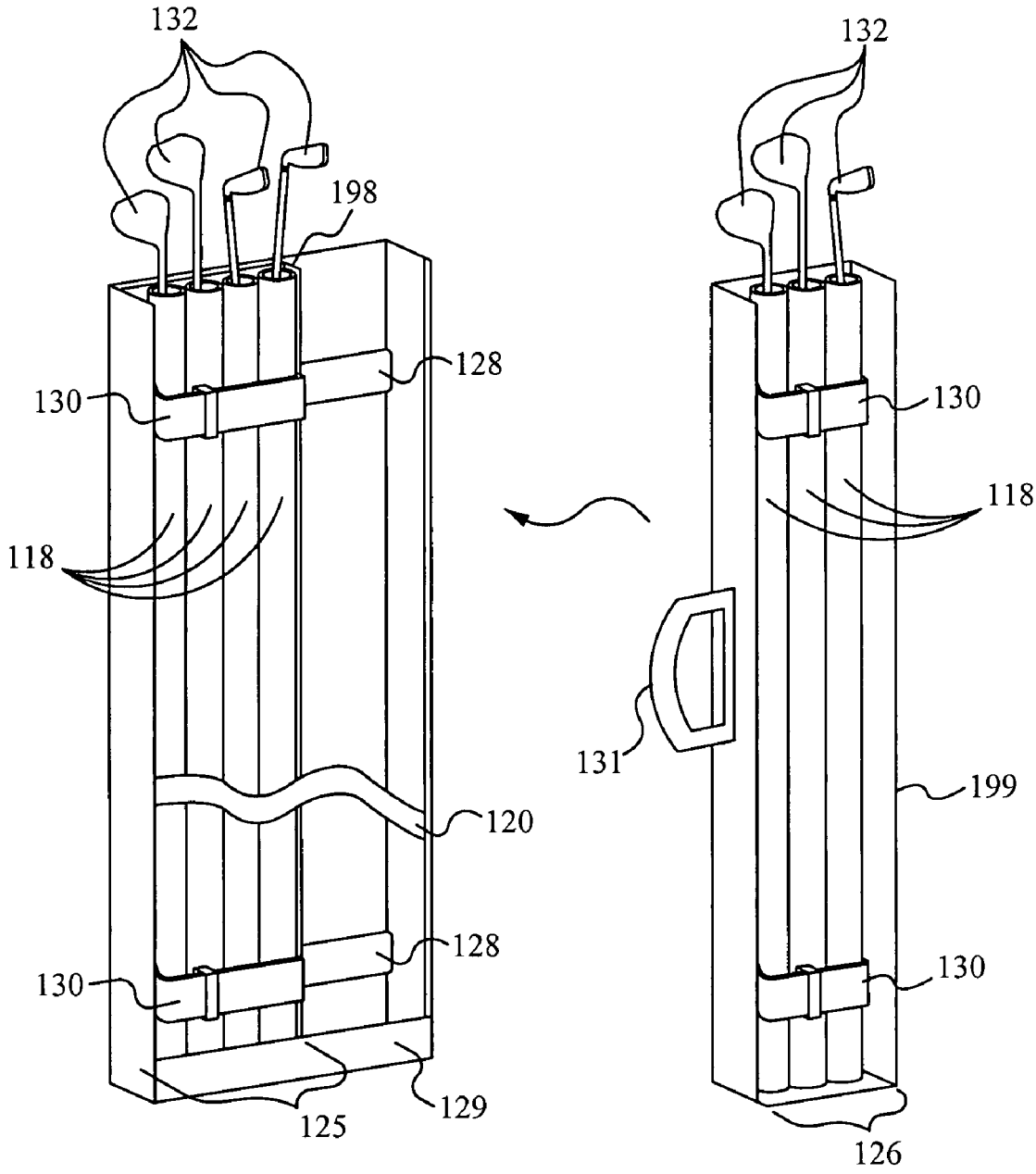
FIG. 5 is a detailed isometric view of a side section and pack inserts according to some embodiments of the present invention.

FIG. 5 is an isometric view of side section 103 of the golf club bag according to some embodiments of the present invention shown. The side section 103 is detached from the center section 102. As shown, the side section comprises two removable pack inserts 198 and 199, which corresponds with the groups 125 and 126, respectively. Also shown are three club holders 118 in insert 199 and four club holders 118 in insert 198. The insert 198 is shown bound to the side section 103 with a strap 130. One side of an attachment means 128 is located on the inside back portion of the side section 103 to secure the removable pack inserts 198 and 199 within the side section 103. The one side of an attachment means 128 can be selected from, but is not limited to, the following: hook and loop fasteners, snaps, lockable pivot mechanisms, hooks, a C-clamp device or pressure clips. The corresponding attachment means (not shown) is located on the back sides of pack insert 198 and 199. A bottom shield 129 further ensures that the pack inserts 198 and 199 stay in place.

The insert 126 is shown taken out of the side section 103 and detached from the attachment means 128. The removed insert 126 can be carried independently via a handle 131. This configuration has distinct advantages of traditional golf bags. Many times a golfer needs to carry a club to take a shot because carts are not allowed in a certain area of the course. Often a group of clubs is needed at a particular region for close successive shots, i.e. chipping out of sand then using another iron or chipping on the green then putting or because the exact club cannot be determined until the true lie of the ball is known. Traditional bags require a golfer either make two trips to the cart to access the clubs needed for these shots or required a golfer to carry two clubs. When a golfer carries more than one club at a time, it is easy to forget where the golfer had set the unused club, especially if playing in long grass or near trees. The present invention allows a golfer to select a group of clubs 132 needed for successive shots and allows the golfer to carry them in the pack inserts. The pack inserts are light, easy to carry, will not get lost like individual clubs and are easy to organize. Often times the pack inserts can be organized in advance in anticipation of common golf scenarios like chipping, then putting for example.

The present invention is especially designed for use in a golf cart. Traditionally, bags are strapped onto the cart and held rigidly in place. Such a placement, however, limits the functionality of the golf bag because when it is tethered to a cart, half of the pockets are inaccessible and effectively rendered. Golfers who organize their bags by placing items all the pockets must either reach around the bag and feel blindly for items or unstrap the bag, turn it, retrieve what they need, turn the bag back around and finally, strap the bag back into place. The present invention allows golfers to use a golf bag with a cart while still allowing easy access to all accessories. It allows users to rotate their clubs for easy access and to detach a group of clubs and to easily walk with them.

Figure 6:
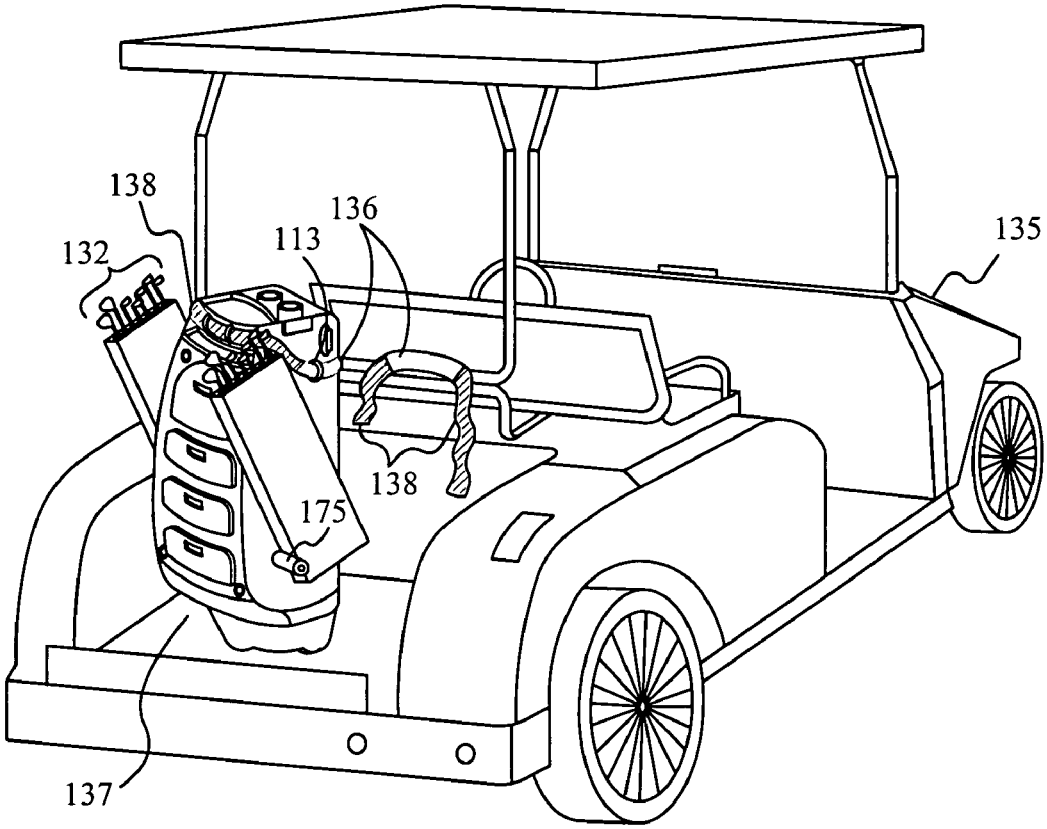
FIG. 6 is an isometric view of a the golf bag with use on a golf cart according to some embodiments of the present invention.

FIG. 6 shows a golf bag with a golf cart according to some embodiments of the present invention. Here the golf bag 100 is set on surface 137 and strapped to the golf cart 135 by bag securing means. The bag securing means comprises a semicircle upper frame 136 which cradles a golf bag and straps 138 which extend from the ends of the semi circle upper frame 136. Such straps are commonly threaded through a handle or similarly appropriate opening located on a traditional golf bag and connected to secure the bag Accordingly, side of the center section 102 of the golf bag of the present invention has rings 113 which serve as an appropriate opening to accommodate such straps 138. Furthermore, the front of the center portion 102 has a strap area 115 to further hold the apparatus. The rings 113 can be accessed easily, even with the side sections 101 and 103 attached to the center section 102 simply by rotating side sections 101 and 103 on the pivot 119. Once secured, the side sections 101 and 103 can be rotated back to a resting position, or can be kept in a rotated position to easily access clubs 132.

In some embodiments of the present invention, a stopping means 175 is built into the center section 102 and is pulled from the center section 102 and blocks the side sections 101 or 103 from rotating back to their resting positions.

The present invention provides many advantages to traditional golf bags. As explained, the present invention provides a golfer using a cart with full access to the items stored within the bag. Also, the invention allows the golfer to rotate the side sections on the bag when they are coupled with the bag, thus enabling the golfer to more easily see the clubs. Furthermore, the side sections of the golf bag of the present invention can be removed. This lets the golfer to choose a group of appropriate clubs and allows the golfer to carry just those clubs in a light insert pack to the next shot, facilitating a less physically strenuous golf round. The golf bag of the present invention easily straps to a golf cart. Furthermore, the golf bag of the present invention is designed to store a full range of golf gear and accessories.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device and method of the present invention could be implemented in several different ways and have several different appearances.

What is claimed is:

1. A golf bag for use with a golf cart comprising:

a. a center section, the center section having a body, wherein the body is sufficiently rigid to provide structure to the center section;

b. a first side section, wherein the first side section comprises at least two individual golf club pack inserts removably coupled within the first side section, wherein the first side section is removably coupled to a first side of the center section via a first coupling mechanism; and c. a second side section, wherein the second side section comprises at least two individual golf club pack inserts removably coupled within the second side section, wherein the second side section is removably coupled to a second side of the center section via a second coupling mechanism, wherein the center section is configured to be coupled to a golf cart via a golf cart strap such that the golf cart strap does not interfere with an ability of the individual golf-club pack inserts to be removed from the center section when the center section is strapped into a golf cart, and wherein the individual golf-club pack inserts are configured to group golf clubs and carry a subset of the golf clubs independently.

2. The golf bag for use with a golf cart according to claim 1, wherein at least one accessory storage compartment is accessible from the front of the center section of the bag.

3. The golf bag for use with a golf cart according to claim 2, wherein the at least one accessory storage compartment is a drawer.

4. The golf bag for use with a golf cart according to claim 2, wherein the at least one accessory storage compartment is a pocket.

5. The golf bag for use with a golf cart according to claim 1, the center section further comprising a top section, the top section having at least one surface to place accessories.

6. The golf bag for use with a golf cart according to claim 1, the center section further comprising a top section, the top section having at least one channel extending from the top section through the center section, wherein long and substantially straight accessories are stored in the at least one channel.

7. The golf bag for use with a golf cart according to claim 1, the center section further comprising at least one loop, wherein the loop holds the golf cart strap, wherein the golf cart strap is threaded through the at least one loop to secure the bag to a golf cart.

8. The golf bag for use with a golf cart according to claim 1, wherein each side of the center section has at least one loop, wherein the golf cart strap is threaded through the at least one loop to secure the golf cart bag, and wherein the at least one loop is accessible when at least one of the first side and the second side is coupled to the center section.

9. The golf bag for use with a golf cart according to claim 1, the center section further comprising a bottom section, wherein the bottom section fits into the back section of a standard sized golf cart.

10. The golf bag for use with a golf cart according to claim 1, wherein the first side section contains at least one golf club holder tube.

11. The golf bag for use with a golf cart according to claim 1, wherein each of the individual golf club pack inserts has a means for carrying.

12. The golf bag for use with a golf cart according to claim 1, wherein the first side section is capable of rotating on the first coupling mechanism from a resting position.

13. The golf bag for use with a golf cart according to claim 12, further comprising a means for securing the first side section after the first side section has rotated about the coupling mechanism, thereby preventing the first side section from rotating back to the resting position, thereby providing a user the ability to more clearly see the golf clubs held within the first side section.

14. The golf bag for use with a golf cart according to claim 13, wherein the means for securing the first side section is a pin coupled to the center section.

15. The golf bag for use with a golf cart according to claim 1, wherein the second side section contains at least one golf club holder tube.

16. The golf bag for use with a golf cart according to claim 1, wherein the second side section is capable of rotating on the second coupling mechanism from a resting position.

17. The golf bag for use with a golf cart according to claim 16, further comprising a means for securing the second side section after the second side section has rotated about the coupling mechanism, thereby preventing the second side section from rotating back to the resting position, thereby providing a user the ability to more clearly see the golf clubs held within the second side section.

18. The golf bag for use with a golf cart according to claim 17, wherein the means for securing the second side section is a pin coupled to the center section.

* * * * *